United States Patent [19]

Rosen et al.

[11] Patent Number: 4,738,375

[45] Date of Patent: Apr. 19, 1988

[54] TAMPER RESISTANT AND TAMPER INDICATING CLOSURE

[75] Inventors: Joseph L. Rosen, Bal Harbor, Fla.; Dale M. Metcoff, Flossmoor, Ill.

[73] Assignee: Rockwell Valve Corporation, Arlington Heights, Ill.

[21] Appl. No.: 898,049

[22] Filed: Aug. 19, 1986

[51] Int. Cl.[4] ..... B65D 17/40

[52] U.S. Cl. ..... 220/276; 220/270; 215/256; 222/185

[58] Field of Search ..... 220/270, 276; 215/256; 222/185, 153

[56] References Cited

U.S. PATENT DOCUMENTS 3,474,930 5/1968 Lerner ..... 222/182

4,326,649 4/1982 Marino et al. ..... 222/182

*Primary Examiner*—George T. Hall

*Attorney, Agent, or Firm*—Gerald R. Hibnick

[57] ABSTRACT

A typical dust cover for aerosol cans is improved to be more tamper resistant and tamper indicating by adding a specialized tearoff strip. This new combination of dust cover with depending and tight fitting tearoff strip is unitary, has latching lug means as part of both the skirt of the dust cover and the upper edge of the tearoff strip for latching under the valve mounting cups of the can, inhibits the normal camming lever arm, and when the tearoff strip is removed there remains a visually prominent, sinuous bottom edge to the dust cover.

21 Claims, 1 Drawing Sheet

TAMPER RESISTANT AND TAMPER INDICATING CLOSURE

BACKGROUND OF THE INVENTION

This invention concerns a container closure which is both tamper resistant and tamper indicating. More specifically, this invention is directed to a closure for pressurized cans typically filled with materials, such as commercial food products, sold in retail stores. The goal of this invention is to inhibit or at least greatly discourage the unauthorized release of the gas, nitrous oxide, which propells the product from the can, and also to provide an especially visable indication if the closure prior to sale has been removed and remounted, or even if there has been a partial attempt to remove the closure.

Although the need for tamper indicating as well as for tamper discouraging closures for many types of consumer goods long has been recognized and generally well met, so as to ensure that the purchaser obtains a full container and there was no accidental or environmental product contamination, only recently there has arisen an urgent need for great improvement in both tamper indicating and tamper resistant closures, to prevent intentional tampering and/or contamination of the goods by individuals who wish to do bodily harm to the ultimate purchaser of the goods, or to cause financial hardship to the manufacturer of the goods, or to obtain some "feature" from the goods without purchase of a large quantity of the goods.

A specific example of a "feature", which recently has become a cause for human intentional tampering, is nitrous oxide. Nitrous oxide is employed in so-called "aerosol" cans for propelling foods and other substances through a valve assembly at the top of the can. Partial actuation of the valve assembly by tampering will permit escape of the nitrous oxide gas, without delivery of the goods, such as cream topping. An obvious result of withdrawing some or most of the nitrous oxide is that there will be insufficient gas in the can to propell most of the contents and, the ultimate purchaser has been cheated. However, the real concern lies in the fact that the nitrous oxide is being inhaled or "sniffed" intentionally by the tamperer, so as to obtain an exhilaration or "high". This concern is not based on morality, but is predicated upon public health and safety. Abuse of nitrous oxide has been associated with several serious diseases, disorders, or conditions. Also, exposure to nitrous oxide in high concentrations can result in asphyxiation. As with the abuse of drugs, alcohol, and other substances, the potential damage to the abuser, the sniffer, of nitrous oxide is of no concern to the sniffer. Nevertheless, it is incumbent upon the manufacturers and packagers of aerosol products to take steps to reduce the ease of nitrous oxide abuse by delivering the product in a more tamper resistant and/or tamper indicating package.

DESCRIPTION OF THE PRIOR ART

The closures for aerosol type containers typically are called dust covers, since one of their prime purposes is to keep the otherwise exposed dispensing nozzle or valve from environmental contamination. Another prime function of the closure is to prevent the dispensing valve means from contacting anything which would cause the valve to be actuated accidentally by its tilting or depressing. Hence, the prior art dust covers have been designed to be tight fitting and somewhat rigid, but neither tamper resistant nor tamper indicating. Typical examples of such prior art are: Soffer U.S. Pat. Nos. 3,128,004; Whitehouse 3,927,796; Smith 2,980,299; and Marino 4,326,649.

Patents have issued to so-called "tamper proof" and also tamper indicating dust covers, but they would not meet today's needs. For example, Soffer U.S. Pat. No. 2,643,015 and Bucher et al. U.S. Pat. No. 3,028,992 employ very small retention portions adjacent a lever arm. When the lever arm is pivoted for normal removal of the dust cover, the retention portions fracture to provide the tamper indication. Clearly, there is no "tamper proof" capability, since it is only the normal removal effort and action of the dust cover which is required. Moreover, the very small retention portions are hardly visable when intact and/or broken. Gach U.S. Pat. No. 3,322,298 requires a blade, such as a screwdriver tip, to be inserted through an opening in the side wall of the cap and then the handle of the screwdriver is used as a lever to pry off the tight fitting cap. This arrangement has no provision for indicating tampering, has an opening which would permit entry of environmental contaminants, and would be inconvenient for use in the typical kitchen.

Circumferential thin rings and bands now are commonly used to help secure the screw caps of soda bottles and milk containers against accidental rotational and/or levered removal. In one type, the ring remains on the bottle neck. Similarly, thin tearoff bands have been considered for retaining clsoures. Examples of these closures are McKernan U.S. Pat. Nos. 3,266,676; Crisci et al. 3,504,818; Faulstich 3,672,528; and Bean 4,216,872. Unfortunately, none of these closures meet the new criteria of being significantly a tamper deterant against intended human tampering. These closures employ rings and bands which are fractured easily and/or removed, and the absence of the small ring or band hardly is noticeable; nor is it seen easily that the ring, which remains on the neck after severing, is slightly spaced from the cap upon its replacement.

Some food and medicine containers now are overwrapped by a clear plastic, in addition to their normal closure means. Such expedient has the commercial disadvantage of being costly and requiring additional packaging equipment.

SUMMARY OF THE INVENTION

This invention improves the quality and effectiveness of prior art tamper indicating and tamper resistant closures, and especially is adapted for use as a dust cover for cans which employ nitrous oxide to propell and/or aerosolize material through a valve or nozzle. This invention easily is adaptable to use with most presently employed dust covers, typified by the cited Soffer U.S. Pat. Nos. 2,643,015, Smith 2,980,299, Bucher et al. 3,028,992, Soffer 3,128,004, Whitehouse 3,927,796, and Marino 4,326,649 patents and adds relatively little to the total cost of the dust cover. This novel dust cover can be mounted onto the can with little modification to the existing packaging equipment.

This invention adds to the existing dust covers a depending tearoff strip which is relatively wide and tightly encircles the neck of the aerosol can. The width, thickness, and tight fit of the tearoff stip, in combination with the dust cover lugs (which are part of the typical dust cover and are secured under the mounting cup at the top of the can) prevent this improved dust cover from being removed or even partly raised from the neck of the aerosol can until the tearoff strip is separated from the skirt of the dust cover. If the dust cover has a camming lever arm which operates when rotated downward, the tearoff strip can lie in its path and reduce its leverage capability, to further inhibit removal of the dust cover prior to removal of the tearoff strip. The upper edge of the tearoff strip can have lug means which will be retained under the mounting cup until the strip is removed manually. Hence, even if the basic dust cover has no lugs, the depending tearoff strip part of this new closure provides this very desirable feature to reduce tampering capability.

Tamper indicating is by virtue of the significant width of the tearoff strip and its clearly visable position around the neck of the can. Additionally, the tear or fracture line joining the top of the tearoff strip to the bottom of the main body of the dust cover is not straight, but intentionally sinuous or wavy, so that when the tearoff strip is removed, there remains all around the bottom of the dust cover a sinuous demarcation line between it and the neck of the can.

Each of the Figures are approximately two times the size of a commercial embodiment.

DESCRIPTION OF THE PREFERRED EMBODIMENTS

Figure 1:
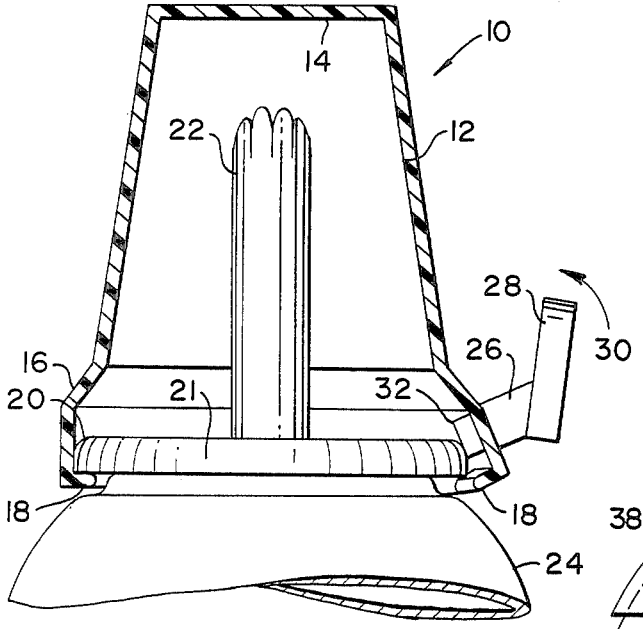
FIG. 1 is a side view, partly in section, of a dust cover representative of the prior art seated on an aerosol can.

The dust cover 10 of FIG. 1 is typical of the prior art, but not intended to represent any presently commercialized dust cover. It is of molded plastic, has a cylindrical side wall 12, and is closed by a top 14. The lower portion of the side wall defines a skirt 16, which is provided with a plurality of radial lugs 18, that latch under the annular rim 20 of the mounting cup 21 of the can. Passing upward through the center of the mounting cup is the tilt action valve 22. The mounting cup 21 is seated into the neck 24 of the can. A lever arm 26 with actuator 28 is mounted to the skirt 16 proximate to one of the lugs so that, by pressing upon the actuator, the lever arm causes the proximate lug 18 to be pulled out from under the rim 20 of the mounting cup and then urges slight horizontal displacement of the skirt, so that the other lug or lugs then slip outward from under the rim and permit upward removal of the dust cover, without the side wall 12 coming into contact with the valve 22.

As shown by the arrow 30, the actuator 28 is to be moved upward and inward toward the side wall 12. In the normally latched position, the lever arm 26 would be horizontal and has an inward edge or blade 32 which cams on the side and/or top of the rim 20 as the actuator is being pressed inward and upward, as shown in FIG. 1. When the dust cover is returned onto the neck 24 of the can 10, the camming action is reversed and the lever arm 26 and actuator 28 automatically are returned to their original position. Hence, the normal removal of the typical dust cover 10 provides neither a deterant to tampering, nor is there any tamper indicating. Although the prior art teaches that the lever arm 26 can be secured to the skirt 16 by small, thin frangible webs, such webs do not physically deter tampering and, when broken, are not readily noted and thus are not adequate for tamper indicating.

Figure 2:
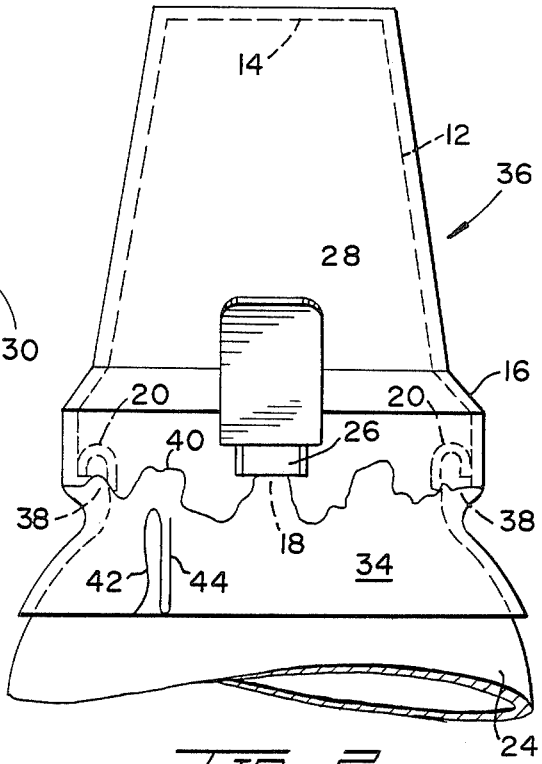
FIG. 2 is a front view of the dust cover of FIG. 1 which has been modified by the present invention.

According to the present invention, a novel tearoff strip 34 is formed as part of and depending from the typical dust cover. FIG. 2 illustrates this new dust cover 36, the view being 90° clockwise from FIG. 1 and the common reference numbers being employed. To enhance the tamper deterant aspect, the width and tightness of the tearoff strip 34 relative to the neck 24 of the can should be such that the cover with strip cannot merely be lifted up from the can. The strip should be relatively inelastic, so that a twisting and/or tilting action by a tamperer does not cause the strip to stretch and lose its tight fit around the neck, especially its narrowest part near the mounting cup 21. The new dust cover 36 should have lug means, either as part of the skirt 16, or as part of the tearoff strip 34, and preferrably both. Near the top edge of the strip 34 there are provided at least two lugs 38 which project upward under the annular rim 20. Hence, even if there are no lugs 18 on the skirt, the new closure has lug means to deter tampering. Thus, unless the tearoff strip is removed, its lugs 38 will prevent removal of this dust cover 36.

To enable normal removal of the tearoff strip 34, there is provided a fracture line 40, which can be scored, be thinner, or weakened, or otherwise formed as generally well known. Handle means 42 is provided at one end of the strip 34 to facilitate the manual removal of the entire strip. Preferably, the handle means 42 should project from the neck 24. FIG. 2 illustrates the handle extending radially outward. Differences in handle shape, size, and orientation with respect to the strip 34 and the neck 24 can depend upon neck shape, shipping, and packing criteria, etc. Assuming that the tearoff strip will be removed in a clockwise pulling action to break along the fracture line 40, the handle means 42 preferrably should be located slightly clockwise of the lever arm 26, so that the entire strip and its lugs 38 will have to removed before the actuator 28 can be used to force the lug 18 from under the rim 20—a truly tamper deterring construction.

Figure 3:
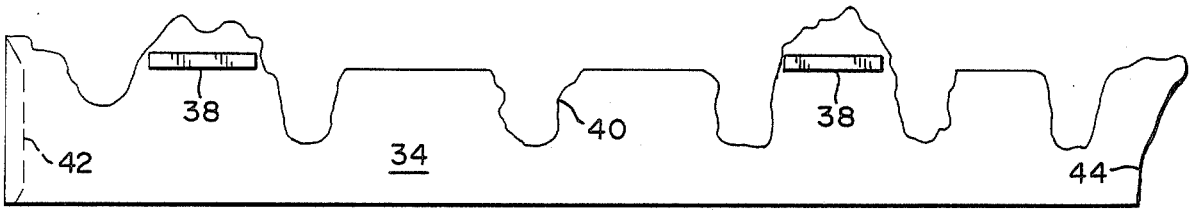
FIG. 3 is a flattened view of the tearoff strip of the invention.

As easily seen from FIGS. 2 and 3, the facture line 40 is not horizontally straight, but is decidedly curvy or sinuous. It also could be wavy or sawtoothed, as long as the adjacent vertical peaks are well separated horizontally and vertically to provide significant visual recognition if the tearoff strip is removed. It would be best for the neck 24 and the dust cover to be of distinctively different colors, so that the sinuous remainder at the bottom of the dust cover, along the fracture line 40, would be visually evident, even at a distance of a few feet or a meter, to provide tamper indication. Hence, presence of the wide tearoff strip 34, approximately half the height of the neck, around the neck 24 of the aerosol can and depending from the skirt 16 should be a clear indication that the dust cover 36 has not been removed and then replaced by anyone, especially a tamperer.

FIG. 3 shows the tearoff strip 34 oriented with its lugs 38 directed outward from the plane of the drawing and the handle means 42 directed into the plane of the drawing and at the left side. As shown, the fracture line 40 lies outside of the lugs 38, so that these lugs are part of the tearoff strip. Conversely, the fracture line excludes, i.e., is below the lugs 18, which will remain on the skirt 16 after the strip is removed. Such limitations leave considerable freedom to the visual appearance of the contour of the fracture line, and those shown and discussed are illustrative and not limiting.

Figure 4:
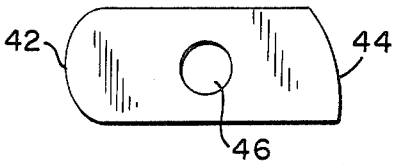
FIG. 4 is a view of the handle portion of the tearoff strip.

FIG. 4 illustrates one preferred form of the handle means 42, by whch the user would grip between the thumb and forefinger and pull to tear off the strip along the fracture line 40. At the end of the strip, is a short vertical fracture element 44, which is broken as the handle is first pulled generally outward and clockwise. Because the strip is intentionally wide, relatively inelastic and as thick as necessary to thwart tampering, the amount of pulling force upon the handle 42 will be more than slight—somewhat childproof. Since hands are sometimes wet or oily in a kitchen environment, the handle should be roughened or ribbed to increase the grip. Also, there can be provided an aperture 46 through which the tine of a fork, or point of a pencil, or the like can pass to form a removing tool. The aperture can be present when delivered to the retail store, or can be defined by a circular fracture line which, if quite weak, will break easily when first used and cause the material "of the hole" to fall out. Hence, any attempt to tamper by manipulation of the handle could cause the aperture 46 to appear.

Figure 5:
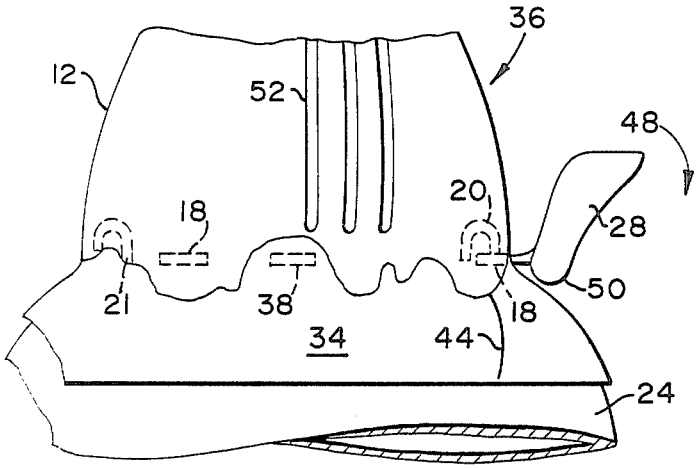
FIG. 5 is a fragmentary side view of the invention combined with another basic form of dust cover.

The embodiment shown in FIG. 5, a partial side view, is different from that of FIG. 2 primarily in that the actuator 28 is of the press down type, as pointed out by the arrow 48. Such motion causes the surface 50 of the actuator to cam over the neck 24, and not the rim 20 of the mounting cup 21, to force the lug 18 out from under the rim 20, and shift the dust cover slightly leftward to free lug means remote from the surface 50. Now therefore, the presence of the tearoff strip 34, lying on the neck 24, presents a barrier to the camming motion 48, since it effectively raises that portion of the neck 24 and changes the camming mechanics significantly. It is to be remembered that the material of the tearoff strip is relatively inelastic and appropriately thick. Hence, the lug 18 proximate the cam surface 50, both of which are part of the lower portion of the side wall of this dust cover, will not be removed from under the rim 20 and the dust cover will not be shifted laterally leftward to free the remote lugs 18. Of course, the tearoff strip should have its lug means 38 to further defeat tamper attempted removal. Thus, this embodiment is more tamper resistant than that of FIG. 2.

For ease of illustrating the right side of FIG. 5, the handle means 42 is not shown, but the fracture element 44 is shown. Ribs 52 are shown in part on the side wall 12. Ribs, flutes internal or primarily external, or the like are recommended to provide for a stiffening of the side wall 12. If the side wall was too flexible, the lugs 18 might be dislodged from under the rim 20 by peripheral squeezing of the dust cover.

It is envisioned that molding constraints, as well as shapes of the neck and mounting cup, might prevent the lug means 18 on the lower portion of the side wall 12 and the lug means 38 on the tearoff strip from being aligned along a common line. In such case, the lug means 38 can be positioned lower than the lug means 18 and be employed as the tamper resistant lug means; whereas, the lug means 18 would be employed only subsequent to removal of the tearoff strip. Although tamper indicating would not be changed, the number of lugs for tamper resistance would be reduced; hence, the number of lugs comprising the lug means 38 should be increased. As viewed in FIGS. 2 and 5, the lugs 18 and the camming related portions 26, 28, 32, and 50 would be at an elevation slightly above the top of the mounting cup 21.

Other adaptions to this novel dust cover 36 with its tearoff strip 34, to accomodate for other forms of dust covers and necks, should now lie within the skill of the art without departure from the spirit and scope of the invention as defined by the following claims.

What we claim is:

1. A tamper resistant and tamper indicating dust cover for an aerosol can that has a neck which supports a mounting cup and upward through which passes a product dispensing valve, the mounting cup has a rim of slightly larger diameter than the closely adjacent portion of the neck supporting it, said dust cover comprising: a cylindrical side wall closed over its top and having a lower portion with a diameter substantially equal to the diameter of the rim for frictional fit thereover; camming means and actuator means mounted to said lower portion for camming a proximate part thereof generally above or outward of the rim to facilitate removal of said dust cover from the can; a tearoff strip depending from said lower portion and joined thereto by a fracture line, said tearoff strip encircling and extending downward with tight fit upon the neck to a significant distance below the mounting cup, to be visually apparent from a distance and resistant to movement above the rim of the mounting cup, without separation along said fracture line.

2. The dust cover according to claim 1 including lug means as part of at least one of said lower portion and said tearoff strip, said lug means being of such size and position to seat under the rim and be resistant to upward removal of said dust cover.

3. The dust cover according to claim 2 in which said lug means is part of said tearoff strip and lies near the top thereof so that most, if not all, of said strip has to be separated from said lower portion along said fracture line prior to said lug means being freed from under the rim of the mounting cup.

4. The dust cover according to claim 2 in which said lug means is part of both said tearoff strip and said lower portion, and is positioned on said lower portion to be operatively responsive to said camming means.

5. The dust cover according to claim 4 in which said fracture line is sinuous and passes above said lug means of said tearoff strip and passes below said lug means of said lower portion.

6. The dust cover according to claim 1 in which said actuator is constructed to force said camming means downward toward the tearoff strip encircled neck and is inhibited from moving sufficient to accomplish camming because of the interposed tearoff strip.

7. The dust cover according to claim 1 in which said fracture line significantly departs from being horizontal and straight, so as to leave a visually discernible, irregular bottom edge to said dust cover after said tearoff strip is removed.

8. The dust cover according to claim 1 in which said tearoff strip has at its beginning handle means which projects generally radially outward.

9. A tamper resistant and tamper indicating dust cover for an aerosol can that has a neck which supports a mounting cup and upward through which passes a product dispensing valve, the mounting cup has a rim of slightly larger diameter than the closely adjacent portion of the neck supporting it, said dust cover comprising: a cylindrical side wall closed over its top and having a lower portion with a diameter substantially equal to the diameter of the rim for frictional fit thereover; a tearoff strip depending from said lower portion and joined thereto by a fracture line, said tearoff strip encircling and extending downward with tight fit upon the neck to a significant distance below the mounting cup to be visually apparent from a distance; lug means formed on said tearoff strip and so positioned to fit under the rim and be resistant to movement above the rim of the mounting cup without said strip being removed by separation along said fracture line.

10. The dust cover according to claim 9 in which said fracture line is sinuous and provides a clear indication when said tearoff strip is removed.

11. The dust cover according to claim 10 in which the color of the neck of the can and the color of said lower portion are distinctively different to enhance the visual indication that the tearoff strip has been removed.

12. The dust cover according to claim 9 further comprising: camming means and actuator means mounted to said lower portion for camming a proximate part thereof generally above or outward of the rim to facilitate removal of said dust cover from the can, said actuator being constructed to force said camming means downward toward the tearoff strip encircled neck and being inhibited from moving sufficient to accomplish camming because of the interposed tearoff strip.

13. The dust cover according to claim 12 in which lug means also is formed on said lower portion to fit under the rim at a position to be responsive to said camming means for removal from under the rim.

14. The dust cover according to claim 9 in which said tearoff strip is formed with handle means which includes a tool receiving portion for aiding in the removal of said strip.

15. The dust cover according to claim 14 in which said tool receiving portion is defined by an area including a perforation through said handle means.

16. The dust cover according to claim 9 in which the width of said tearoff strip is approximately one-half the height of the neck of the can.

17. The dust cover according to claim 9 in which said side wall contains a plurality of vertically disposed stiffening ribs.

18. A tamper resistant and tamper indicating closure for a package having a neck with an upper edge having a perimeter slightly greater than the perimeter of the neck just below the upper edge, the neck and upper edge otherwise lacking threads and detent means, said closure comprising: an upper part and a lower part joined together by a fracture line, said upper part being constructed and arranged for frictional fit over the upper edge of the neck, both said upper part and lower parts including lug means directed inward sufficiently to be positioned under the upper edge, said lug means of said upper part being separate from said lug means of said lower part, and both said lug means oriented for being retained under the upper edge of the neck, said fracture line being generally sinuous such that, upon separation of said lower part from said upper part along said fracture line, said lug means of said lower part also is separated from said lug means of said upper part, and said lower part of said closure being constructed and arranged to fit tightly against the neck until separated along said fracture line.

19. The closure according to claim 18 further including lug means withdrawing means mounted to said upper part for withdrawing its lug means from under the neck.

20. The closure according to claim 19 in which said lower part is positioned with respect to said withdrawing means to inhibit its operation.

21. The closure according to claim 18 in which both said lug means are oriented along a common straight line.

* * * * *